United States Patent [19]

Shotwell

[11] 3,968,843

[45] July 13, 1976

[54] PNEUMATIC PERCUSSION TOOL HAVING A VIBRATION DAMPENED HANDLE

[75] Inventor: Daniel B. Shotwell, Washington, Ill.

[73] Assignee: Caterpillar Tractor Co., Peoria, Ill.

[22] Filed: Feb. 21, 1975

[21] Appl. No.: 551,796

[52] U.S. Cl. ..... 173/139; 173/162; 267/137

[51] Int. Cl.[2] ..... B25D 9/04

[58] Field of Search ..... 173/162, 139, 137; 267/137; 16/116 R

[56] References Cited

UNITED STATES PATENTS

| | | | |
|---|---|---|---|
| 2,019,964 | 11/1935 | Hamerly | 173/162 |
| 2,058,583 | 10/1936 | Forss | 173/162 |
| 2,500,036 | 3/1950 | Horvath | 173/137 X |
| 3,542,095 | 11/1970 | Frederickson | 173/162 X |

*Primary Examiner*—Ernest R. Purser
*Assistant Examiner*—William F. Pate, III
*Attorney, Agent, or Firm*—Robert E. Muir

[57] ABSTRACT

A pneumatic hammer is provided with a handle which is isolated from the body of the tool so that vibrations of a reciprocating hammer are dampened. This is accomplished by a shock absorbing insert located between the handle and reciprocating hammer. The insert includes a rubber cushion member bonded to two steel coupling members, one of which is bolted to the handle and the other which is bolted to the body of the tool. An air passageway extends through the handle and cushion member to reciprocate the hammer. To protect the rubber from deterioration from the oil transported with the pressurized air, a neoprene liner is provided which extends through all of the members and which also as a flange at the remote face of each of the coupling members to provide sealing gaskets thereat.

17 Claims, 5 Drawing Figures

13
10
12
11
14
16
9
54
32
52
34
15
40
30
II
II
58
24
18
22
26
19
28
C 32
40a
32c
40
32g
32a
30
34
52
40b
34g
56
34a 34
56
58
52
52
58
54
22
56
56
58
52

PNEUMATIC PERCUSSION TOOL HAVING A VIBRATION DAMPENED HANDLE

BACKGROUND

The invention pertains to pneumatically powered percussion tools of a type designed to be held in pressed relation to the work under pressure exerted by the operator on the handle of the tool.

In tools of this nature, a piston hammer is pneumatically reciprocated at a rapid rate to pound a work implement. The force of the blows transmitted to the work varies with the pressure exerted by the operator upon the handle of the tool. A problem with existing tools of this general nature arises from the shock and vibration accompanying such operation which is transmitted to the operator through the handle. This subjects the operator to undesirable discomfort and is alleged to impair blood circulation in the hand, allegedly damaging the capillary vessels. This condition is commonly referred to as "white hand" or "chipper's syndrome."

One attempt at solving the aforementioned problem is disclosed in U.S. Pat. No. 3,727,700, invented by Lester A. Amtsberg, and issued Apr. 17, 1973.

Another example, shown in U.S. Pat. No. 2,019,964, issued Nov. 5, 1935 to F. B. Hamerly, provides limited vibration dampening through compression of one of a pair of axially opposed cushion members internally disposed within the tool. The radial restraint imposed by such an arrangement limits radial deformation and consequent dampening capability of the cushion members. Also, even though an oil resistant resilient liner extends through one of the members, adequate sealing is not provided to protect the member from the deleterious effects of oil carried in compressed air passing therethrough.

U.S. Pat. No. 2,058,583, issued Oct. 27, 1936 to F. P. Forss, attempts to overcome the above-described limitations of the Hamerly arrangement. In the Forss patent, complete isolation of the handle from vibration is prevented by a pressurized fluid conducting rigid metal sleeve which protects the cushion member from damage by lubricants carried in the pressurized fluid. An upper end of the metal sleeve is pressed into the handle while the opposite lower end, disposed in close proximity to the vibration producing elements, slidably engages a metal ring secured to the cushion member. Compression of the cushion member is limited to the amount of clearance provided between the lower end of the rigid sleeve and the vibration producing elements. Thus the ability of the cushion member to absorb vibrational forces acting in a direction toward the handle is restricted. The capability of the metal sleeve to protect the cushion member from contamination by lubricants is solely dependent on the integrity of the metal-to-metal sliding joint between the sleeve and ring. Such joints are generally undesirable for sealing since some clearance between the contacting surfaces must be provided to permit free and substantially frictionless movement therebetween. It is normal for initially controlled tolerances to increase during operation, thereby decreasing the sealing ability of the joint. Additionally, while the rigid sleeve does not inhibit stretching or extension of the cushion member in absorbing vibrational forces acting in a direction away from the handle, such extension draws the lower end of the sleeve away from the vibration producing elements, simultaneously decreasing the sealing surface contact area between the sleeve and ring. The reduced sealing surface contact area further reduces the sealing ability of the joint.

Another structure is shown in U.S. Pat. No. 2,035,643, issued Mar. 31, 1936 to C. N. Douglass et al. The shortcomings of this prior art structure are similar to those of the above-described Forss patent.

It is desirable to provide a pneumatic percussion tool with a handle which is isolated from vibrations, and which overcomes the shortcomings of the prior art.

OBJECTS

It is a general object of the present invention to provide a pneumatic percussion tool with a handle which is isolated from vibrations, thereby avoiding transmission of the vibrations to an operator.

Another object is to provide a tool in accordance with the foregoing object and which includes a cushion member disposed between the handle and barrel of the tool.

A further object of the invention is to provide a tool in accordance with the foregoing objects and which has a resilient liner in the air supply passage through the cushion member to protect the cushion member from deterioration from oil passing through the passage.

Another object of the present invention is to provide a tool in accordance with the foregoing object in which the resilient liner has flanges extending laterally along the outer face of coupling members at opposite sides of the cushion member to provide sealing gaskets for the air passage.

These, and other objects and advantages of the present invention, will become apparent as the same becomes better understood from the following detailed description when taken in conjunction with the accompanying drawings.

DRAWINGS

DESCRIPTION

Figure 1:
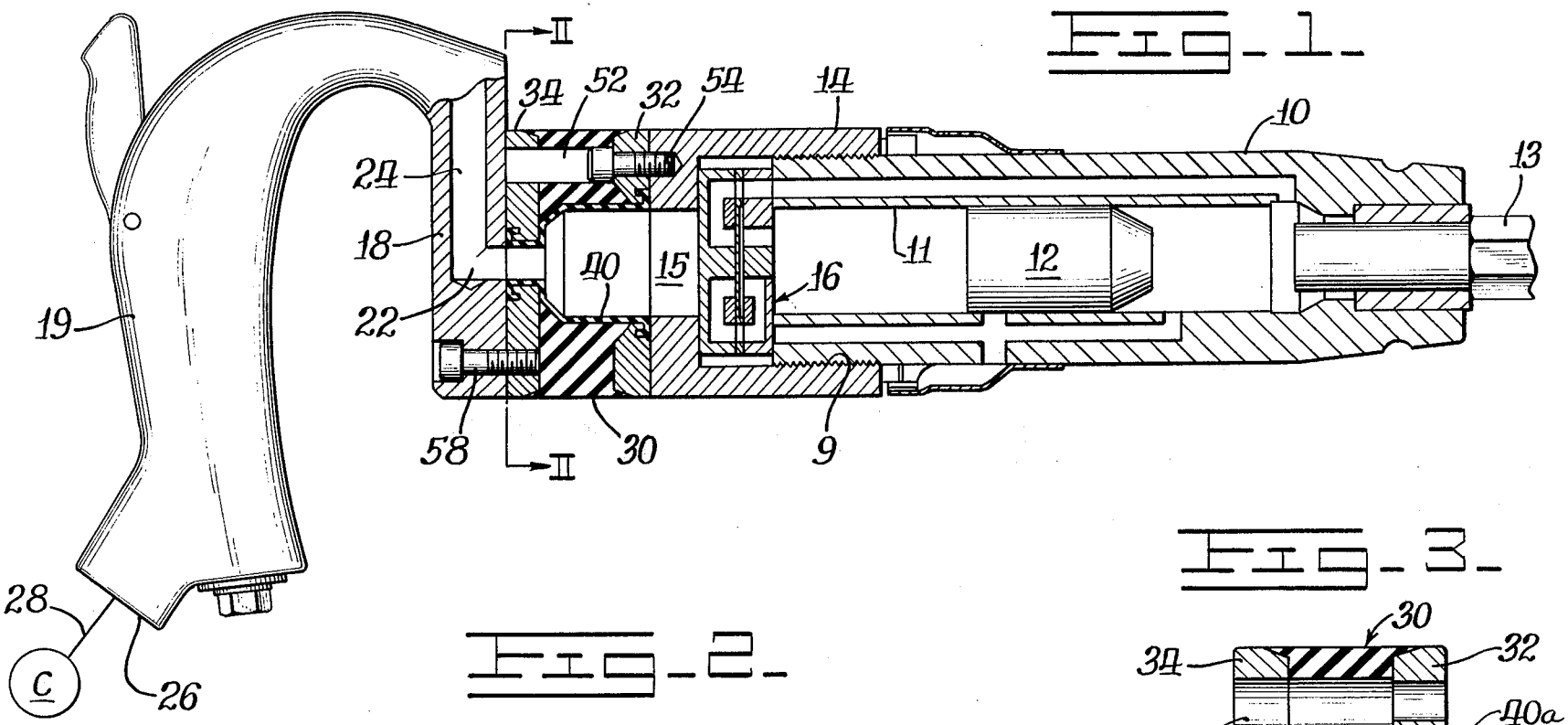
FIG. 1 is a view, partly elevational and partly sectional, of a pneumatic hammer provided with a vibration dampened handle in accordance with the present invention.

Reference is now made more particularly to the drawings which illustrate the best presently known mode of carrying out the invention and wherein similar reference characters indicate the same parts throughout the several views.

The portable percussion tool illustrated in FIG. 1 includes a body defined by a barrel or cylinder 10 having a chamber 11 in which a piston hammer 12 is pneumatically reciprocable at a high frequency to pound a work element, such as a chisel 13. A backhead 14, threadedly fixed at 9 to the cylinder, provides a valve chamber 15 in which a conventional air-blown distributing valve 16 is arranged. The valve functions automatically in response to live air entering the valve chamber to direct the air alternately to opposite ends of the hammer chamber 11 to reciprocate the hammer or impacting element 12. The construction of the hammer, distributing valve and the chamber may be of any construction well known in the art. One suitable construction is shown and described in the aforementioned U.S. Pat. No. 3,727,700.

The handle for the tool is disposed at the rear end of the barrel 10 and comprises a coupling portion or section 18 and a hand grasping section 19. The coupling section 18 has a flat face at its front and an air passage terminus 22 centrally disposed in its front face. An air passageway 24 extends from the outlet 22 back through the handle to an inlet 26 which is connected to a line 28 leading from a compressor C.

A cushion member 30 is bonded to a pair of coupling members 32,34 to form a shock-absorbing and vibration dampening insert located between the barrel and the handle. The cushioning insert comprises a resilient annulus of natural rubber. The coupling members 32 and 34 are formed of steel and have their faces adjacent the cushion member 30 roughened as by sand blasting prior to bonding thereto.

The members have aligned air pressure supply passages extending therethrough and, in the embodiment illustrated, the passage in coupling member 34 is smaller to generally correspond with the size of the terminus or outlet 22 whereas the passage in coupling 32 is larger, generally corresponding to the size of the chamber 15. This, plus the fastening means hereafter described, reduces the area of the coupling member 32 to which the rubber cushion member 30 may be bonded. To compensate for this loss, the coupling member 32 is chamfered as at 32*c*. Annular chamfers 32*a* and 34*a* are also provided to eliminate a sharp corner between the coupling members and the cushion member 30. This serves to reduce the possibility of the bond being broken.

Figure 3:
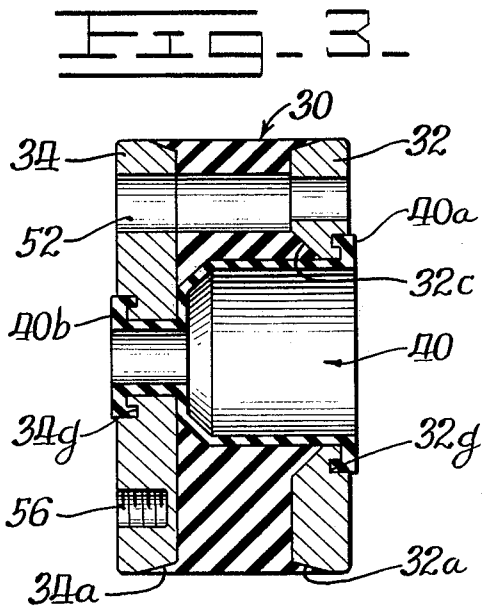
FIG. 3 is an enlarged cross sectional view of the vibration damping insert constructed in accordance with the present invention.
Figure 2:
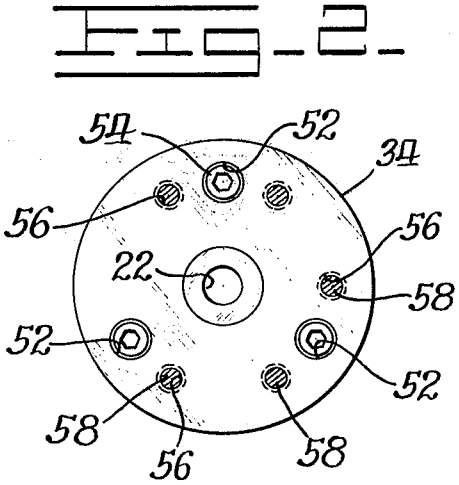
FIG. 2 is a cross sectional view taken along line II—II of FIG. 1.

An oil-resistant liner 40 is disposed in said aligned supply passages of the members. The liner is preferably formed of an oil-resistant, but resilient material such as neoprene. In accordance with the present invention, this liner should be unitary or one-piece so that it extends beyond the juncture between the coupling members and the cushion member in each instance, to fully protect the cushion member 30 against deterioration caused by contaminants in the air passing therethrough. As best seen in FIG. 3, the shape of the liner is complementary to the shape of the aforedescribed passages.

In the preferred embodiment illustrated, coupling member 32 has an L-shaped groove 32*g* in its face adjacent the barrel 10. Groove 32*g* extends entirely around the outlet of the air passageway. In similar fashion, connector member 34 has an L-shaped groove 34*g* extending around the inlet of its air passageway. As can be seen, the diameter of groove 34*g* is smaller than the diameter of groove 32*g*. Each of the grooves, however, being L-shaped, provides for a turn back lock for flanges 40*a* and 40*b*, respectively, of the one-piece liner. These flanges are preferably unitary with the rest of the liner and have a thickness greater than the depth of the corresponding grooves, as best seen in FIG. 3. This additional thickness of the flanges 40*a* and 40*b* forms a sealing gasket between each respective coupling member and its adjacent handle and barrel. When clamped in place, as hereinafter described, this provides an airtight seal for the pressurized air passing through the insert.

From the above description, it is deemed apparent that the cushioning member 30 will dampen the vibrations transmitted to the handle of the hammer whereas the oil-resistant resilient liner 40 provides a three-fold function: it protects the cushion member 30 from lubricant entering with the incoming pressure fluid to prevent deterioration thereof; and it provides seals between the coupling member and the handle and between the other coupling member and the barrel. The particular shape of the flanges which provides the seal cooperates with grooves in the coupling members so that the resulting sealing gasket is locked into the face of the coupling members to assure that the sealing gasket created by the flange will not be distorted and the seal destroyed by the vibrations in this type of tool. The flanges also anchor the central portion of the liner and help assure that no oil reaches the cushion member.

A plurality of openings 52 pass through the coupling members and the cushioning member to accommodate bolting of the coupling member 32 to the barrel 10. As best seen in FIG. 3, the opening to the coupling member 32 is of smaller diameter than that through the coupling member 34 and cushioning member 30 to provide a shoulder against which the head of a bolt 54 can bear. It is deemed apparent that the opening through coupling member 34 and cushioning member 30 is sized to accommodate that head. A plurality of other openings 56, conveniently five in number, are provided only in coupling member 34 and have threaded interiors to accommodate a number of bolts 58 passing through the handle portion 18.

In assembly, the coupling member 32 is first bolted onto the barrel 10 by means of bolts 54 disposed in openings 52. Thereafter, the handle is bolted onto coupling member 34 by means of bolts 58. The bolts 54 and 58 should be drawn sufficiently tight to sufficiently compress the flanges 40*a* and 40*b* of insert 40 to provide an annular seal around the air pressure passageway.

Figure 4:
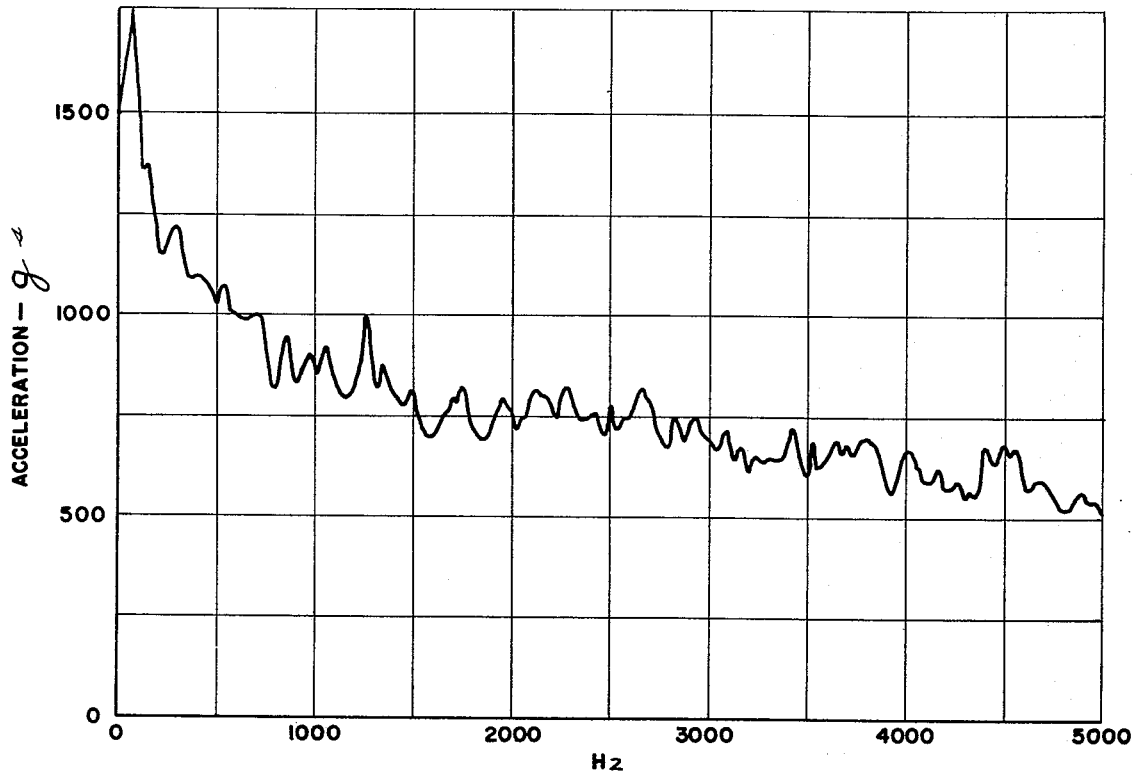
FIG. 4 is a graph of acceleration in g's versus Hz for a standard hammer.
Figure 5:
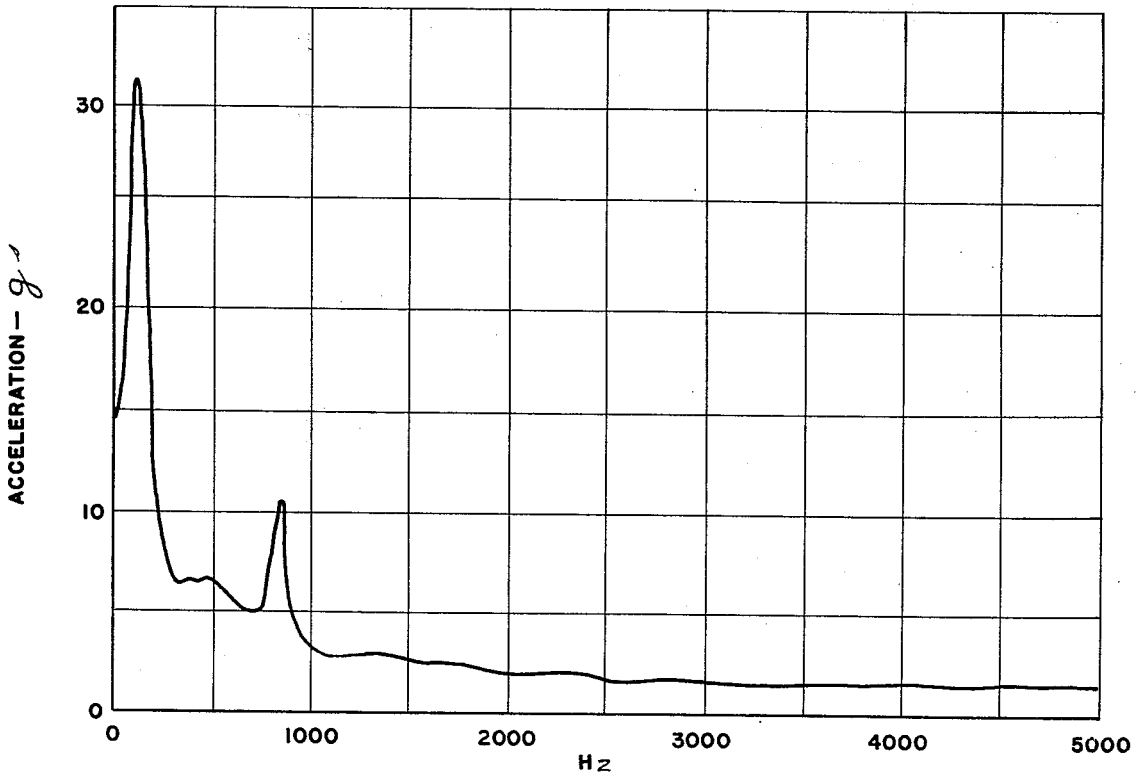
FIG. 5 is a graph of acceleration in g's versus Hz for the same hammer modified in accordance with the present invention, the vertical scale being 1/50 of that in FIG. 4.

By way of illustrating the effectiveness of the present invention in reducing vibrational forces transmitted to the hand of an operator during operation of a pneumatic tool, comparative measurements of the acceleration of the tool handle were recorded on a representative hammer before and after modification to include the handle isolating means described above. FIG. 4 is a graph of the acceleration in g's, one g representing an acceleration of 32.2 ft/sec$^2$ (9.8 m/sec$^2$), over a frequency range of 0 to 5000 Hz as measured on the handle of a standard No. 1 Simplate chipping hammer manufactured by Chicago Pneumatic Tool Company of New York, N.Y. The peak acceleration on the unmodified hammer was approximately 1750 g at 50 Hz. Further, an acceleration level of 1000 g to 500 g was recorded through the frequency range of 500 Hz to 5000 Hz. After modification to include the cushion member and resilient liner detailed in FIG. 3, the acceleration was again measured under the same controlled conditions as the unmodified hammer, with the results shown in FIG. 5. A peak acceleration of only 31 g occurring at 100 Hz was measured, with the exception of a second peak of approximately 10 g at 870 Hz. The acceleration level of the modified hammer is less than 3 g through the range of 1000 Hz to 5000 Hz. As demonstrated by the graphs of FIGS. 4 and 5, a tool constructed in accordance with the present invention is effective to reduce the acceleration of the handle by as much as 99%.

While a preferred embodiment of the invention has herein been illustrated and described, this has been done by way of illustration and not limitation, and the invention should not be limited except as required by the scope of the appended claims.

What is claimed is:

1. A portable pneumatic percussion tool having a barrel; pneumatically actuated apparatus in the barrel; a vibration-dampened handle secured at one end of the barrel and including a hand-grasping section having an air pressure supply passage therein; a cushion member of resilient rubber disposed between the handle and barrel; a pair of metal plate coupling members each on opposite sides of the cushion member and each bonded thereto; the coupling members and cushion member having aligned air pressure supply passages extending therethrough; a unitary, oil-resistant, one-piece, resilient linear which completely lines the air supply passages of said members; the resilient liner having first and second integral flanges extending laterally along the outer face of each coupling member and circumjacent the air pressure supply passage; each flange having an outer face extending beyond the adjacent outer face of the coupling member to provide an annular sealing gasket between each respective coupling member and its adjacent handle and barrel; and means for securing each respective coupling member to its adjacent handle and barrel with the annular sealing gasket compressed sufficiently to provide an airtight seal.

2. A portable pneumatic percussion tool having a barrel; pneumatically actuated apparatus in the barrel; a vibration-dampened handle secured at one end of the barrel and including a hand-grasping section having an air pressure supply passage therein; a cushion member of resilient rubber disposed between the handle and barrel; a pair of coupling plates each on opposite sides of the cushion member and each bonded thereto; the coupling plates and cushion member having aligned air pressure supply passages extending therethrough; a unitary, oil-resistant, one-piece, resilient liner which completely lines the air supply passages of said members; the resilient liner having flanges extending laterally along the outer face of each coupling plate to provide an annular sealing gasket between each respective coupling member and is adjacent handle and barrel; first fastener means for securing one coupling plate to the barrel with the annular sealing gasket compressed sufficiently to provide an airtight seal; and second fastener means, separate and distinct from the first fastener means, for securing the handle to the other coupling plate with the annular sealing gasket compressed sufficiently to provide an airtight seal; whereby each respective coupling plate is secured to its adjacent handle and barrel.

3. A portable pneumatic percussion tool as set forth in claim 2 wherein the inner face of each coupling plate is sand blasted; and the means for bonding the coupling plates to the cushion member comprises an adhesive bond coat secured to the sand blasted face and the cushion member.

4. A portable pneumatic percussion tool as set forth in claim 2 wherein the oil-resistant, resilient liner is formed of a material of the type having oil resistant characteristics such as neoprene.

5. A portable pneumatic percussion tool having a barrel; pneumatically actuated apparatus in the barrel; a vibration-dampened handle secured at one end of the barrel and including a hand-grasping section having an air pressure supply passage therein; a cushion member of resilient rubber disposed between the handle and barrel; a pair of coupling members each on opposite sides of the cushion member and each bonded thereto; the coupling members and cushion member having aligned air pressure supply passages extending therethrough; a unitary, oil-resistant, one-piece, resilient liner which completely lines the air supply passages of said members; the resilient liner having flanges extending laterally along the outer face of each coupling member to provide an annular sealing gasket between each respective coupling member and its adjacent handle and barrel; each coupling member having an annular groove in its outer face surrounding its air pressure supply passageway; each flange of the resilient liner being disposed in the corresponding groove and having a thickness greater than the depth of its corresponding groove; and means for securing each respective coupling member to its adjacent handle and barrel with the annular sealing gasket compressed sufficiently to provide an airtight seal.

6. A portable pneumatic percussion tool as set forth in claim 5 wherein each groove is L-shaped and its corresponding flange is shaped complementary thereto.

7. A portable pneumatic percussion tool as set forth in claim 6 wherein the inner face of each coupling member is roughened; the cushion member is formed of a natural rubber; the means for bonding the coupling member to the cushion member comprises an adhesive bond coat secured to the roughened face and the cushion member; and the oil-resistant, resilient liner is formed of neoprene.

8. A shock absorbing and vibration damping insert for location between the handle and percussion mechanism of a portable pneumatic percussion tool and comprising, in combination: a cushion member of resilient rubber; first and second metal coupling members bonded to opposite sides of the cushion member; the members having an air supply passage extending therethrough; an oil-resistant, resilient element completely lining the air supply passage; at least one of the coupling members having a groove in its face remote from the cushion member and surrounding the terminus of the air supply passage; and the resilient element having a circumjacent flange disposed in the groove and having an outer face beyond the adjacent outer face of the coupling member to provide a sealing gasket.

9. The combination of claim 8 wherein there is a similar groove in the remote face of the other coupling member, and the resilient element has a similar circumjacent flange thereat.

10. The combination of claim 9 including a plurality of openings extending through said other coupling member and the cushion member, the said one coupling member having aligned openings of smaller size to provide a shoulder against which the head of a fastener can bear; and the other coupling member having a plurality of threaded openings therein for reception of other fasteners.

11. In a portable percussion tool including a barrel, an impacting element slidably arranged in the barrel, valve means in the barrel to direct oil ladened pressurized air alternately to opposite ends of the impacting element to cause reciprocal movement thereof, a handle for positional control of the tool, and an air supply passage formed in the handle for conducting the air to the valve means, the improvement comprising: a separable vibratory dampening unit disposed between the barrel and the handle providing the sole connecting means coupling the handle to the barrel in end to end relationship, said unit being formed to provide an air passage therethrough to communicate the supply passage with the valve means, and the unit having an oil resistant liner disposed within said air passage for the full axial dimension of the unit.

12. The combination of claim 11 wherein the vibratory dampening unit includes a pair of coupling plates each on opposite sides of a cushion member and each bonded thereto; and including first fastening means for securing one coupling plate to the barrel, and second fastening means, separate from the first fastening means, for securing the handle to the other coupling plate.

13. The combination of claim 12 wherein the coupling members have fluid supply passages communicating with the passages in the handle and through the cushion member; and the liner means extends along the full length of the passages through the cushion and coupling plates.

14. The combination of claim 13 wherein the liner means has flanges extending laterally along the outer face of each coupling plate to provide an annular sealing gasket between each respective coupling plate and its adjacent handle and barrel.

15. The combination of claim 14 wherein the liner means is formed of a material of the type having characteristics similar to neoprene.

16. The combination of claim 15 wherein the cushion member is formed of natural rubber.

17. For use in combination with the handle and barrel members of a pneumatic percussion tool wherein the handle has an inner flat face provided with an axial passage for conducting operating air to the barrel member and the barrel member has an opposed rear end face provided with an axial passage for reception of said air, a separable vibration dampening unit for detachably coupling the handle to the barrel member, the unit comprising a pair of parallel end plates, a cushion disposed between the plates having one end face bonded to an inner face of a first one of the plates and an opposite end face bonded to an inner end face of the other plate, apertures extending through the unit adapted to receive bolts for detachably bolting the unit to the rear end face of the barrel, threaded apertures in the said first one of the end plates adapted to receive mounting bolts passed through the inner flat face of the handle, the unit having an axial passage alignable with the passages in the handle and barrel, and an oil-resistant liner fitted in the said axial passage of the unit for the full length thereof.

* * * * *

UNITED STATES PATENT AND TRADEMARK OFFICE

CERTIFICATE OF CORRECTION

PATENT NO. : 3,968,843

DATED : July 13, 1976

INVENTOR(S) : Daniel B. Shotwell

It is certified that error appears in the above-identified patent and that said Letters Patent are hereby corrected as shown below:

Col. 5 - line 21: "linear" should be -- liner --.

Col. 5 - line 49: "is" should be -- its --.

Signed and Sealed this

Thirtieth Day of November 1976

[SEAL]

*Attest:*

RUTH C. MASON
*Attesting Officer*

C. MARSHALL DANN
*Commissioner of Patents and Trademarks*